US005703317A

United States Patent [19]

Levilly et al.

[11] Patent Number: 5,703,317

[45] Date of Patent: Dec. 30, 1997

[54] PORTABLE EQUIPMENT FOR IMMOBILIZING PERSONAL FIREARMS

[76] Inventors: Philippe Levilly, Impasse Cesar-Frenck, F-14740 Bretteville-L'Orgueilleuse; Yves A. Leloup, 40, rue du Mont-Valerien, F-92210 Saint Cloud, both of France

[21] Appl. No.: 602,757

[22] PCT Filed: Jun. 15, 1995

[86] PCT No.: PCT/FR95/00788

§ 371 Date: Jun. 3, 1996

§ 102(e) Date: Jun. 3, 1996

[87] PCT Pub. No.: WO95/35476

PCT Pub. Date: Dec. 28, 1995

[30] Foreign Application Priority Data

Jun. 17, 1994 [FR] France ..... 94 07456

[51] Int. Cl.[6] ..... F41A 23/00; F41A 9/62; G01L 5/14; E04G 3/00

[52] U.S. Cl. ..... 89/37.03; 42/94; 89/37.04; 73/167; 248/286.1; 248/278.1

[58] Field of Search ..... 42/94; 89/37.03, 89/37.04, 37.11, 37.13; 73/167; 248/286.1, 278.1, 218.4, 179.1

[56] References Cited

U.S. PATENT DOCUMENTS

| | | | |
|---|---|---|---|
| 499,315 | 6/1893 | Borchardt | 42/94 |
| 2,556,549 | 6/1951 | Motley | 89/37.03 |
| 4,055,017 | 10/1977 | Thompson | 42/94 |
| 4,333,385 | 6/1982 | Culver | 73/167 |
| 4,409,826 | 10/1983 | Wenger | 73/167 |
| 5,375,804 | 12/1994 | Levilly | 248/274 |
| 5,491,920 | 2/1996 | McCullers | 42/94 |
| 5,553,820 | 9/1996 | Karten et al. | 248/286.1 |
| 5,564,667 | 10/1996 | Copeland et al. | 248/278.1 |

FOREIGN PATENT DOCUMENTS

| | | | |
|---|---|---|---|
| 0046181 | 2/1982 | European Pat. Off. . | |
| 2691532 | 11/1993 | France . | |
| 9010200 | 9/1990 | Germany . | |
| 4000091 | 9/1991 | Germany | 42/94 |

OTHER PUBLICATIONS

International Search Report of PCT/FR95/00788.

*Primary Examiner*—Michael J. Carone
*Assistant Examiner*—Theresa M. Wesson
*Attorney, Agent, or Firm*—Baker & Daniels

[57] ABSTRACT

Portable equipment for immobilizing personal firearms characterized by an articulation connecting the baseplate to the rail, and comprising an intermediate part rotatingly connected to the baseplate about axis (XX) by a coupling element. The intermediate portion forces the rail onto its contact surface by means of a tilting member. The freely mounted connecting element is connected to the intermediate part by a pivot axis. The tilting member including a head inserted into the rail and a slide integral with the head and the intermediate part.

8 Claims, 6 Drawing Sheets

PORTABLE EQUIPMENT FOR IMMOBILIZING PERSONAL FIREARMS

BACKGROUND OF THE INVENTION

The invention relates to portable equipment for immobilising personal firearms during test firing, comprising a baseplate secured to an existing holder and bearing a plate pivotable around a first axis and receiving a rail mounted for tilting on the plate around a second axis perpendicular to the first, the rail receiving at least two gun locks slidable along its axis and having slides perpendicular to the rail axis, a U-shaped holder being mounted in the slide of each gun lock in order to receive the firearm for adjusting.

A known stabilisation device conforms to the definition hereinbefore (FR 93 05 371).

Although excellent for stabilising of adjustments around axes, the device is relatively complicated to operate and more particularly is too slow for series adjustment of firearms.

Also, the device has to be adjusted and locked by using tools, and access for locking is required to places which are sometimes hidden by the firearm positioned in the holders.

The object of the invention is to provide a portable device or equipment for immobilising personal firearms during test firing, the device being particularly simple to operate, requiring little adjustment and locking, and being relatively light and easy to install while ensuring extremely stable adjustment and locking.

SUMMARY OF THE INVENTION

To this end the invention relates to equipment of the kind defined hereinbefore, characterised by a joint connecting the baseplate to the rail and comprising:

an intermediate component connected by a connecting element to the baseplate for rotation around the tilt correcting shaft carried by the baseplate, the intermediate component forcing the rail against its bearing surface by means of a tilting member, the connecting element is mounted for free rotation around the rotation shaft secured to the baseplate, connected to the intermediate component by a pivoting shaft perpendicular to the rotation shaft, provided with a clamping member which clamps and thus locks the connecting element on to the intermediate component and the connecting element on to the rotation shaft, the tilting member comprises a head with a shoulder received in the rail and enabling the rail to tilt relative to the head and pulling it against the bearing surface of the intermediate component, a slide rotating integrally with the tilting head and the intermediate component, the slide being received for sliding in the intermediate component, a clamping member acting as a cam and bearing on the slide and the intermediate component in order to pull and lock the rail via the head against the bearing surface of the intermediate component, and screw-effect means for locking the adjustment between the baseplate and the intermediate component and between the rail and the intermediate component.

The equipment comprises a reduced number of clamping points, and clamping tools are not required. Clamping by means of the cam or cone-effect clamping means is very simple and very fast, operation is simplified, but the equipment has excellent stability both in positioning and in adjustment.

According to other advantageous features of the invention:

the connecting element is a U-shaped component having two arms surrounding a bore receiving the rotation shaft and the arms are formed with a bore for the pivoting shaft and comprise a circular arcuate slide centred on the shaft for enabling the component bearing the clamping member extending through the slide to pivot around the shaft for adjusting the angle.

the clamping member is a rod having a threaded end extending through the slide of the connecting element, the threaded end bearing via a nut against the bottom surface of the intermediate component and its head bearing on the top of the component in order to clamp the component against the connecting element and lock the latter on to the shaft.

the tilting means comprises:

a head in the form of a disc having a diameter equal to the inner height of the cavity in the rail, a circular cylindrical prolongation received in a corresponding bore in the wall of the rail, forming a bearing for tilting around the shaft, a slide of non-circular cross-section received in a recess in the intermediate component, and the intermediate component has a bore which rotatably receives a clamping means having a cam surface co-operating with a corresponding surface of the slide for pulling it and locking the rail against the bearing surface of the intermediate component;

the surface of the slide is a conical surface and the surface of the cam is a frusto-conical surface displaced in the direction of the cone axis by screwing the clamping member into the intermediate component.

the members for locking the adjustment around the shaft are double screws fitted between the intermediate component and the baseplate and comprising two threaded rods ending in an assembly eyelet and received in a threaded sleeve, the threaded rods having opposite threads, like the sleeve.

the tilt-locking members are formed by screws carried by the intermediate component and bearing against the top and the bottom of the rail on either side of the shaft, and at a distance therefrom.

the pivoting locking members are screws comprising two threaded rods with opposite threads and a screwing sleeve, the members bearing laterally between the rail and the baseplate.

The various components constituting the equipment are simple mechanical parts which do not break easily, and are easy to manufacture and assemble. The installation also comprises a large number of commercial components, which simplifies problems of maintenance and holding of stocks.

BRIEF DESCRIPTION OF THE DRAWINGS

The invention will now be described with reference to an embodiment diagrammatically shown in the accompanying drawings in which.

DESCRIPTION OF THE PREFERRED EMBODIMENT

Figure 1:
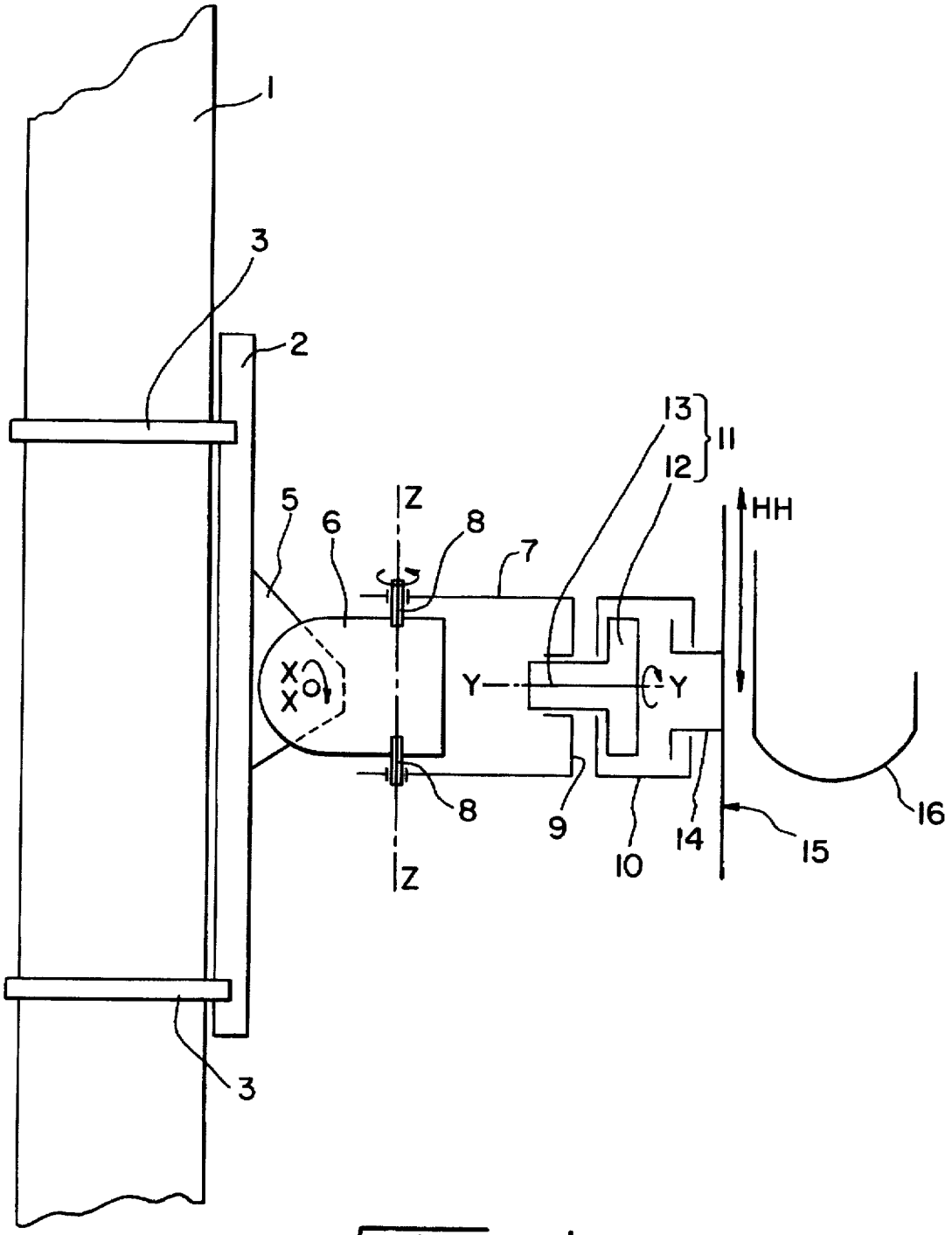
FIG. 1 is a very simplified block diagram of the equipment according to the invention.

As shown in FIG. 1, the invention relates to portable equipment for immobilising personal firearms during test firing. The equipment is for securing to an existing holder 1, such as a tree trunk or electric mast or telephone post. It comprises a baseplate 2 secured to the holder 1 by straps 3 or equivalent fast securing means. The baseplate 2 has a rotation shaft 4 defining the geometrical axis XX for correcting a tilt.

The shaft 4 is e.g. firmly secured in cheeks or flanges 5 of the baseplate 2.

A connecting element 6 is mounted on the shaft 4 so as to be movable in rotation relative to the baseplate 2 around the shaft 4 in order to correct the inclination of the components and elements which it itself carries and which hold the firearm for adjusting.

The connecting element 6 is connected to an intermediate component 7 by a pivoting shaft 8 (axis ZZ) perpendicular to the rotation shaft 4 (axis XX).

The intermediate component 7 has a bearing surface 9 for the rail 10. The connection between the component 7 and rail 10 is provided by a tilting means 11 which enables the rail to tilt and to be locked in the chosen tilting position.

The tilting member 11 comprises a head with shoulder 12 received in the rail 10 and a slide 13 slidable in the intermediate component 7 and adapted to pull the rail 10 against the bearing surface 9 in order to clamp and lock it in a tilting position relative to the intermediate component 7.

The rail 10 receives gun locks 14 provided with securing means for locking the firearm (not shown) for the adjustments shown in the drawing, i.e. zero rotation around the various adjustment axes XX, ZZ, YY is perpendicular to the page in FIG. 1.

To sum up, in FIG. 1 the various axes or shafts are defined as follows:

the shaft 4 (axis XX) is perpendicular to the plane of FIG. 1.

It is horizontal or near the horizontal direction.

It is called the rotation shaft.

The shaft 8 (axis XX) contained in the plane of FIG. 1 is perpendicular to the shaft (axis XX).

It is called the pivoting shaft.

The shaft (axis YY) 12 is perpendicular to the shaft (axis ZZ); it is not contained in the plane of FIG. 1 except when the pivoting motion around the shaft 8 (axis ZZ) is at a zero angle.

It is called the tilting shaft.

The shaft or axis HH parallel to the axis YY corresponds to motion in translation or adjustment of the holder 16 relative to the gun lock 15.

This shaft or axis is called the translation axis.

The axes HH of the various gun locks 15 (and consequently the holders 16) are in general parallel.

The invention also relates to the clamping means equipping the connecting element 6 for clamping the adjustments around the axis XX and the axis ZZ and relates to the means for clamping the tilting means clamping the adjustment of the rail 10 around the axis YY relative to the intermediate component 7.

The means for locking the holders 16 are not described; they are means known in the prior art referred to in the preamble.

The invention also relates to means for locking the adjustments and clampings around the axes XX, YY and ZZ. These means will be described hereinafter.

Figure 2:
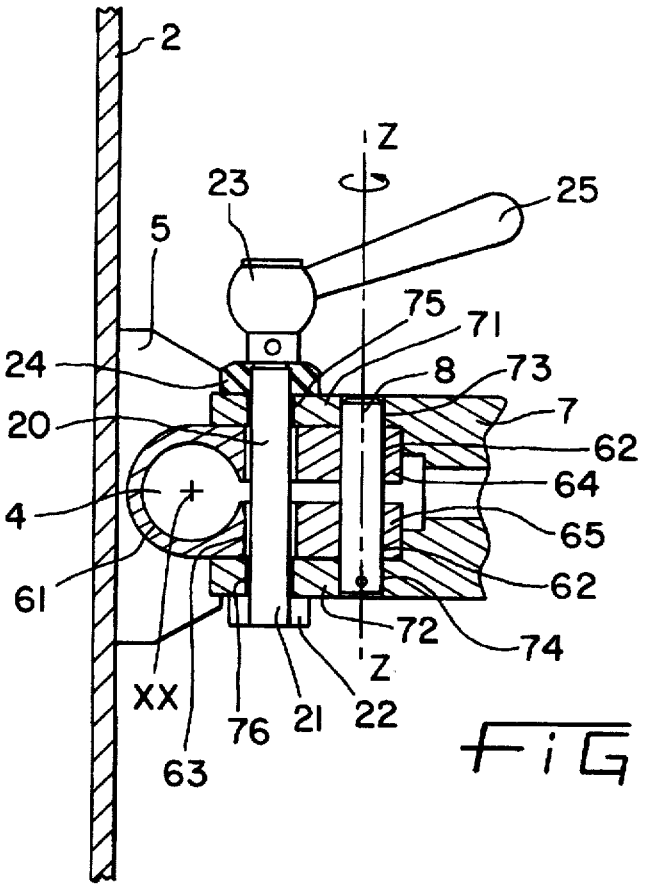
FIG. 2 is a simplified view in section of a part of the equipment at the baseplate.
Figure 4A:
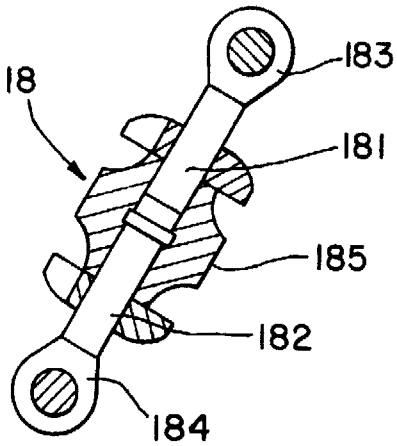
FIG. 4A is an enlarged view of the screw 18 in FIG. 4.
Figure 4:
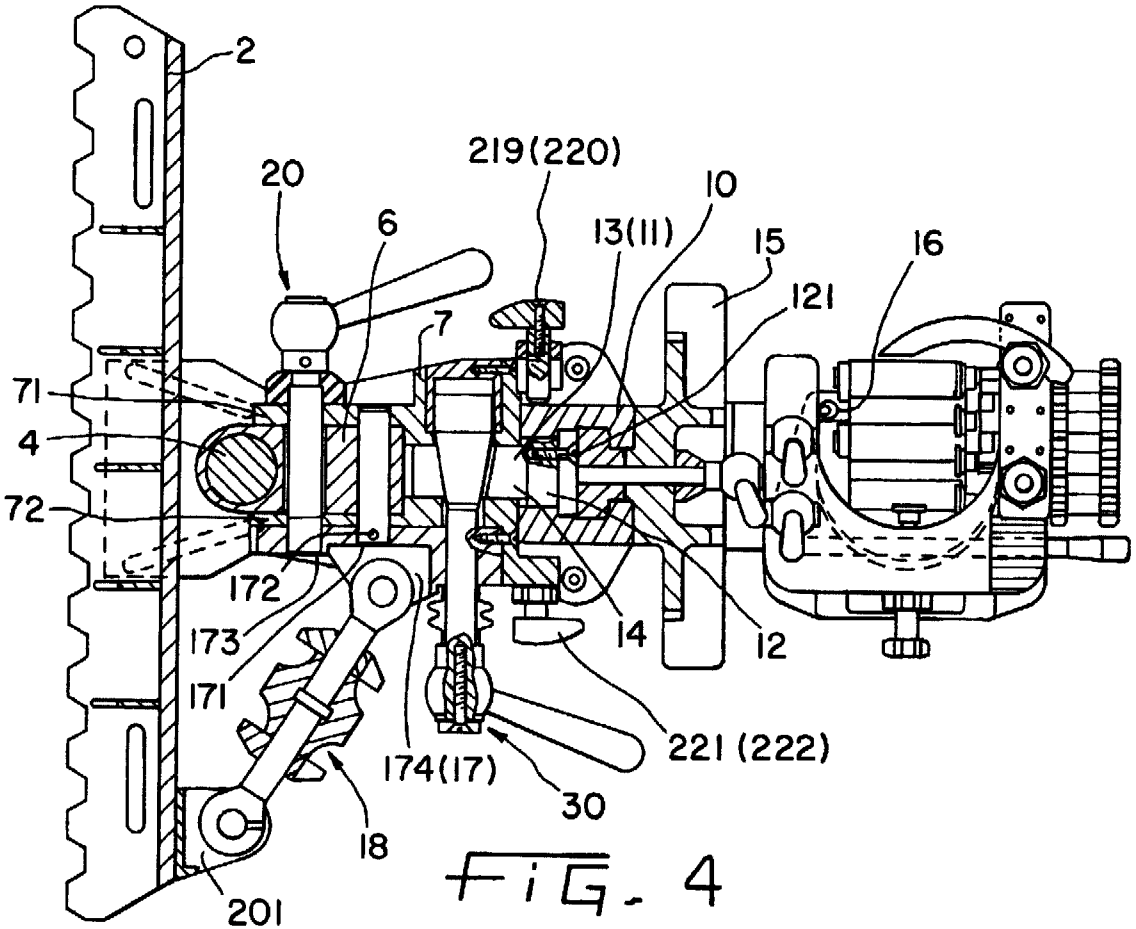
FIG. 4 is a vertical section along the plane of symmetry of an embodiment of the equipment according to the invention, in a simplified drawing.
Figure 5:
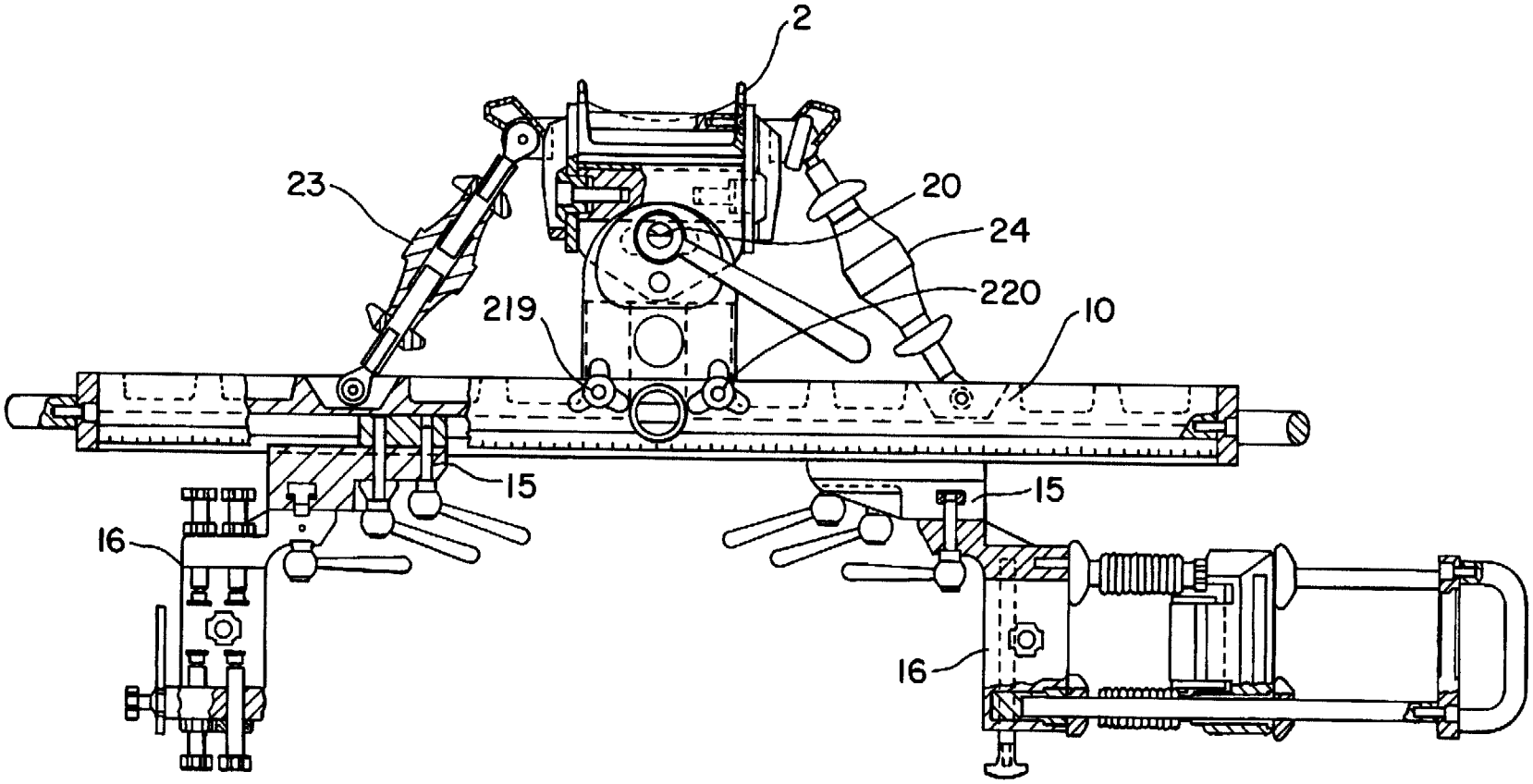
FIG. 5 is a top view, partly in section, of the equipment in FIG. 4.
Figure 6:
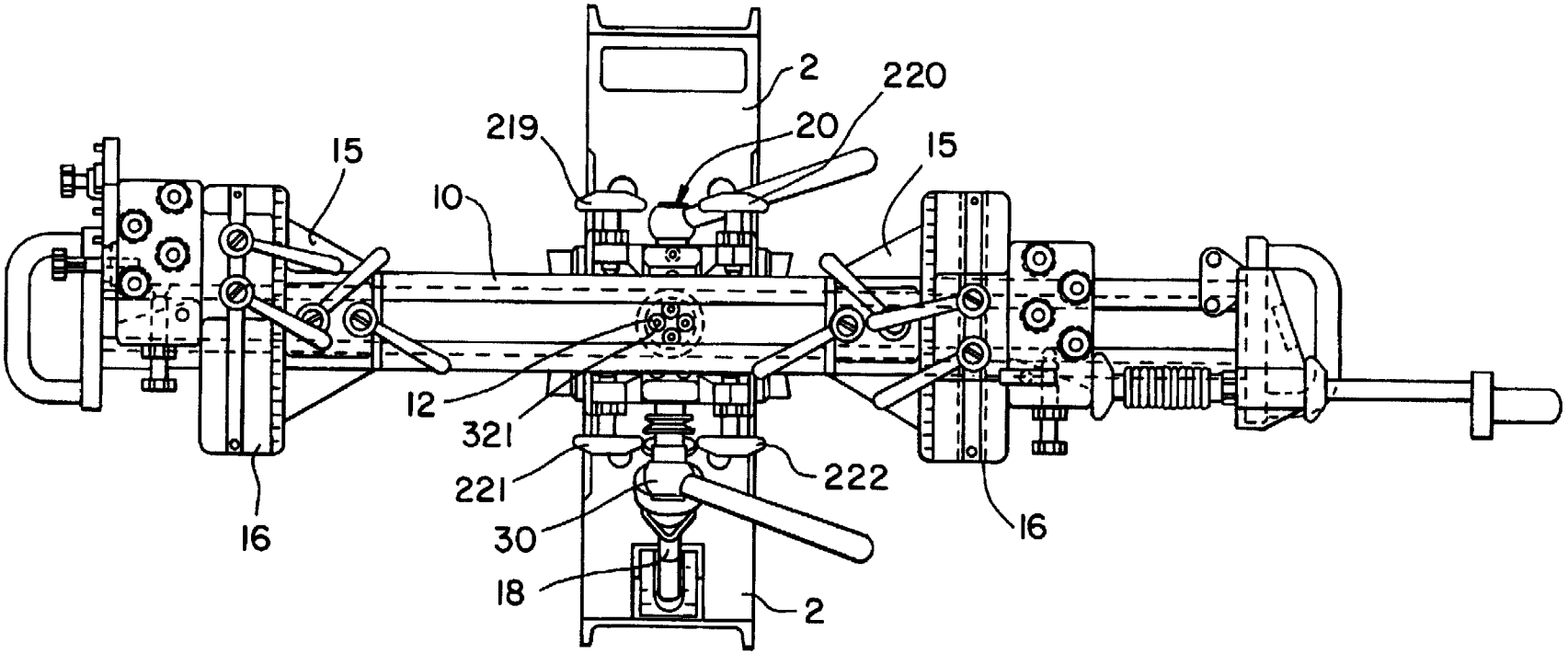
FIG. 6 is a front view of the equipment in FIG. 4.

In greater detail, as in FIG. 2 which however is a simplified view of the embodiment shown in FIGS. 4, 5 and 6, the connecting element 6 is a "horizontal" U-shaped component or equivalent component having a bore 61 for receiving the shaft 4 secured to the cheeks or flanges 5 of the baseplate 2. The connecting element 6 has two arms 64, 65 extending from the bore 61. The arms are slightly spaced apart so that when they are compressed they can close the bore 61 on the shaft 4 and lock the shaft. This component also has a bore 62 for the shaft 8 and a circular arcuate bore 63 centred on the shaft 8 and enabling the intermediate component 7 to pivot around the shaft 8 relative to the component 6. During the pivoting motion, the clamping means 20 remains fixed relative to the element 6 for connecting the clamping means 20.

Figure 2A:
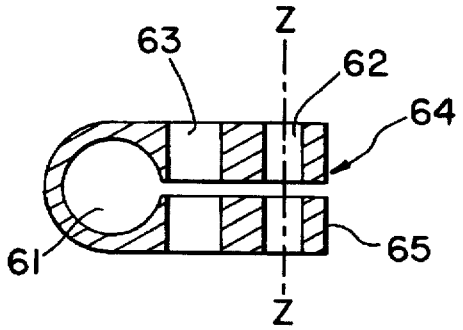
FIG. 2A is a section through the connecting element.

FIG. 2A is a section through the connecting means 6.

In this embodiment, the intermediate component 7 has two cheeks or arms 71, 72 between which the connecting means 6 is disposed. The component 7 has recesses 73, 74 forming the two bearings of the shaft 8 and has two bores 75, 76.

Figure 2B:
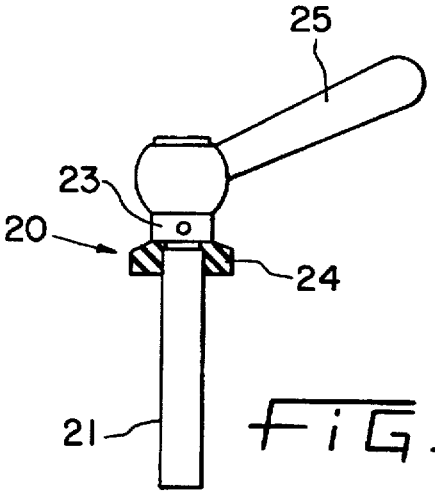
FIG. 2B is a view of the member for clamping the part of the joint in FIG. 2.

The clamping member 20 (FIG. 2B) is a rod whose lower end 21, which is threaded, is received in a nut 22 placed under the lower arm 72. The head 23 of the clamping member 20 bears on the top of the arm 71 via a washer 24. The member 20 has a handle 25 for clamping. When screwed, the member 20 clamps the arms 71, 72 against the connecting element 6, thus immobilising the intermediate component 7 around the shaft 8 (axis ZZ) while compressing the arms 64, 55 in order to lock the element 6 on the shaft 4. Consequently this single clamping operation stops the element 6 rotating around the shaft 4 of the baseplate 1 and stops the intermediate component 7 pivoting around the shaft 8 relative to the connecting element 6. To sum up, clamping of the member 20 results in clamping of the two movements around the axis 4 (XX) and the axis 8 (ZZ) respectively.

Figure 3:
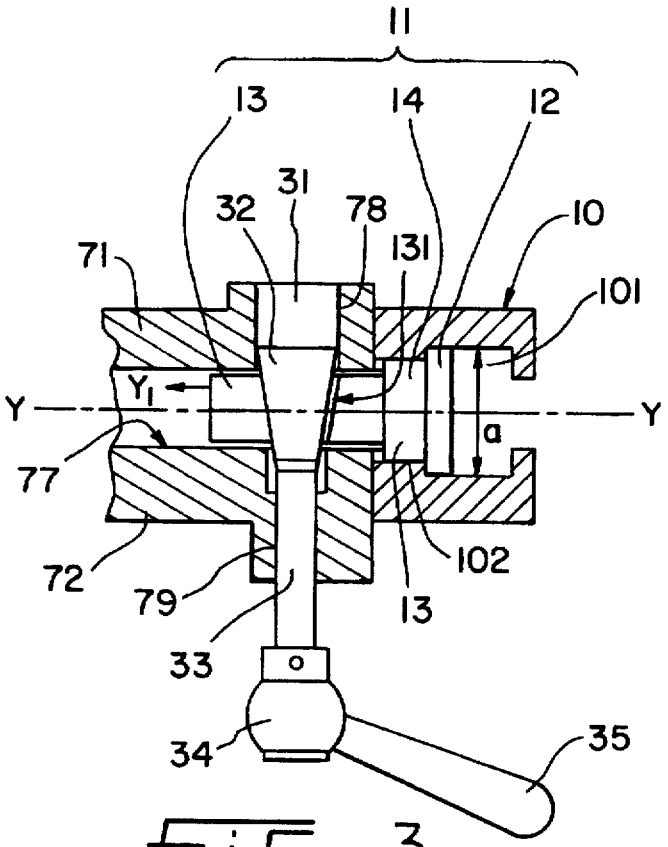
FIG. 3 is a view in section of the other part of the joint, on the side of the rail.

FIG. 3 diagrammatically shows the connection between the rail 10 and the intermediate component 7 via the tilting member 11. The member 11 has a head 12 in the form of a disc of diameter substantially equal to the height (a) of the cavity 101 in the rail 10 and having a smaller-diameter circular cylindrical prolongation 14 received in a bore 102 in the rail and equal in diameter to the prolongation 14 so as to form a tilting bearing.

Figure 3B:
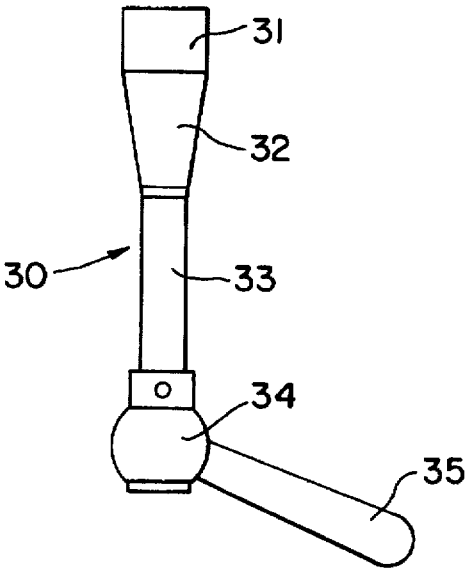
FIG. 3B is a view of the clamping member in FIG. 3.
Figure 3A:
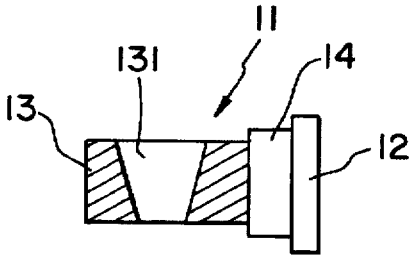
FIG. 3A is a partial section through the tilting means also shown in FIG. 3.

The head 12 is connected via the prolongation 14 to the slide 13 (FIG. 3A). The slide 13 is movably received in a recess 77 having a cross-section (e.g. the slide and the recess have a rectangular or more generally a polygonal section) corresponding to the cross-section of the slide 13, so as to rotate integrally with the intermediate component 7.

In the region of the recess 77, the component 7 has a large-diameter bore 78 in its upper part at the level of arm 71 and a small-diameter bore 79 in the lower part at the level of arm 72. The two bores are coaxial.

The bore 79 is preferably threaded.

This assembly also comprises a clamping member 30 operating as a cam. The clamping member 30 is received in bores 78, 79 extending through the slide 13.

The member 30 (FIG. 3B) has a body 31 substantially equal in diameter to the bore 78 and prolonged by a conical surface 32 followed by a threaded part 33 and a head 34 with a control lever 35.

The slide 13 has a conical bore 131 having the same conicity as the surface 32 of the member 30 but a larger diameter so as to straddle the axis of the bores 78, 79. The surface 32 of the member 30 is adapted to co-operate with the surface of the bore 131 by cam effect. When the member 30 is screwed, it is lowered (in FIG. 3) so that the conical surface 32 to the left in FIG. 3 bears against the corresponding surface of the bore 131 and pushes it (i.e. the slide 13) in the direction of arrow Y1. This movement presses the rail 10 against the bearing surface 9 of the component 7 and thus stops the rail 10 tilting relative to the component 7.

FIGS. 4, 5, 6 are detailed views of an embodiment of equipment according to the invention.

The description of this example will be limited to the means belonging more specifically to the invention, and to details slightly different from the simplified parts shown in the preceding drawings.

However, the references used here will be the same as those hereinbefore, even if the shape of the components in question is slightly modified.

In FIG. 4 the intermediate component 7, under its lower arm 72, has a bearing component 17 serving a number of purposes:

It has a recess 171 for receiving and locking the shaft 8 by means of a pin 172.

It has a thread 173 in line with the bore 63 of the connecting element 6 for screwing the clamping member 20.

The bore replaces the nut 22 (FIG. 2) and

It has a lug 174 for securing an end of a locking screw 18 also connected to a lug 201 on the baseplate 2.

In FIG. 4A, the screw 18 comprises two threaded rods 181, 182 each ending in an eyelet 183, 184 for securing a corresponding shaft to the components to be locked by the screw 18. The threads on the rods 181, 182 are in opposite directions and preferably have the same pitch.

A screwing sleeve 185 has a double thread in opposite directions for receiving the threaded rods 181, 182 in order to lengthen or shorten the distance between the eyelets 183, 184.

The screw 18 in FIG. 4 locks the adjustment around the shaft 4 (axis XX), supplementing the clamping by member 20.

The locking of the tilt (axis YY) of the rail 10 relative to the intermediate component 7 by the tilting means 11 is supplemented in the example in FIGS. 4, 5, 6 by four lock-nut screws 219, 220, 221, 222 screwed into the component 7 above and below the rail 10 on either side of the head 12 (axis YY) so as to have a lever arm. When the tilting member 11 is clamped after adjustment, the position of the rail 10 is locked by screws 219, 220, 221, 222 against the rail 10. Screws 19 to 22 are in turn locked by lock-nuts.

FIG. 5 shows the screws 23, 24 for locking the adjustment movements around the shaft 8 (axis ZZ). Screws 23, 24 are the same as screw 18.

Note in FIG. 6 that the body 31 of member 30 has a sliding jacket 321 forming a bearing surmounting the head 31 and closing the top of the intermediate component 7.

For the purpose of assembling and positioning the member 11 without having to cut off the front of the rail 10 along the axis YY, the head 12 is connected to the cylindrical prolongation 14 by a screw connection 121.

In short, the equipment described hereinbefore can be operated extremely easily and quickly. The adjustments around the axes XX, ZZ, YY are clamped by control-lever members 20, 30 and locked by the screws 19 to 22 and 18, 23, 24.

We claim:

1. An apparatus for immobilizing and holding a personal firearm during test firing, said apparatus comprising:

a base plate adapted to be secured to a support;

a connecting element pivotably connected to said base plate for rotation around a first axis;

an intermediate component pivotably connected to said connecting element for rotation around a second axis, said second axis perpendicular to said first axis, said intermediate component having a bearing surface;

an elongated rail pivotably secured to said intermediate component for rotation around a third axis, said rail including a cavity, said third axis perpendicular to both said first and second axes;

a plurality of gun locks slidably mounted on said rail for sliding longitudinally along said elongated rail, each said gun locks including a slide arranged perpendicular to the longitudinal axis of said rail, said slides each including a U-shaped holder, said U-shaped holders adapted to receive a firearm;

a first clamping member for securing said connecting element against rotation around said first axis and said intermediate component against rotation around said second axis;

a tilting member for pivotably securing said rail to said intermediate component, said tilting member comprising a head received in said rail cavity for enabling said rail to pivot relative to said head, a slide secured to said head and slidably received in said intermediate component, and a second clamping member operatively connected to said slide and said intermediate component for urging said rail against said bearing surface and for thereby securing said rail against rotation around said third axis; and first and second locking means for respectively locking said intermediate component and said rail to said base plate.

2. The apparatus according to claim 1 wherein said connecting element comprises a U-shaped member having two generally parallel arms and a first bore located therebetween, a first shaft received in said bore, a second bore in said arms perpendicular to said first bore, and a second shaft received in said second bore, said first clamping member operatively associated with said second shaft.

3. An apparatus according to claim 2 wherein said second shaft includes a threaded portion, said first clamping means comprising a nut received on said threaded portion and bearing against a first portion of said intermediate component, and a head which bears against a second portion of said intermediate component, whereby said intermediate component is lockingly clamped against said connecting element.

4. The apparatus according to claim 1 wherein said head comprises a circular disk having a diameter equal to the height of said cavity, a cylindrical rod of smaller diameter than said disk connected to said disk and extending through a bore in said rail, said slide connected to said rod, said slide having a non-circular shape and a first camming surface, a bore in said intermediate component, said second clamping member rotatably received in said bore in said intermediate component, said second clamping member having a second camming surface for cooperating with said first camming surface for securing said rail against rotation around said third axis.

5. The apparatus according to claim 4 wherein said first camming surface is conical in shape and said second camming surface is frustoconical in shape and is abaxial with respect to the axis of said first conical surface and is displaced in the direction of the axis of said conical camming surface.

6. The apparatus according to claim 1 wherein said first locking means comprises a double screw member, said double screw member disposed between said base plate and said intermediate component, said double screw member comprising two threaded rods, each said rod having oppositely oriented threads and ending in an eyelet, and a threaded sleeve for engaging said oppositely oriented threads.

7. The apparatus according to claim 1 wherein said second locking member comprises a plurality of screws mounted on said intermediate component, said screws respectively engaging said top and bottom of said rail.

8. The apparatus according to claim 1 wherein said second locking means comprises a plurality of locking members for locking said intermediate component against rotation, said locking members each comprising a double screw member, each said screw member comprising two threaded rods, each said rod having oppositely oriented threads and ending in an eyelet, and a threaded sleeve for engaging said oppositely oriented threads.

* * * * *